United States Patent [19]

Hodge

[11] Patent Number: 4,955,501

[45] Date of Patent: Sep. 11, 1990

[54] TRASH BIN LID-LOCKING DEVICE

[76] Inventor: Allan M. Hodge, P.O. Box 202005, San Diego, Calif. 92120-0925

[21] Appl. No.: 293,939

[22] Filed: Jan. 5, 1989

[51] Int. Cl.[5] ..... B65D 45/00

[52] U.S. Cl. ..... 220/315; 70/164; 220/17

[58] Field of Search ..... 220/1 T, 210, 315, 324; 70/164, 30, 49; 217/66, 68

[56] References Cited

U.S. PATENT DOCUMENTS

| | | | |
|---|---|---|---|
| Re. 30,890 | 3/1982 | Hodge . | |
| 358,732 | 3/1887 | Clisbee | 70/164 |
| 623,380 | 4/1899 | Neiman | 220/315 |
| 677,046 | 6/1901 | Tyden | 220/315 |
| 957,796 | 5/1910 | Parmeter | 220/315 |
| 1,012,602 | 12/1911 | Compton | 220/324 |
| 1,741,241 | 12/1929 | Lau | 217/66 |
| 1,983,436 | 12/1934 | Brunaa | 217/68 |
| 2,262,730 | 11/1941 | Way | 217/66 X |
| 2,730,253 | 1/1956 | Oswalt . | |
| 3,137,408 | 6/1964 | Taylor . | |
| 3,430,468 | 3/1969 | Joseph | 70/164 |
| 3,687,317 | 8/1972 | Gagel . | |
| 3,817,563 | 6/1974 | McGlothin | 220/1 T |
| 3,980,202 | 9/1976 | Monyak | 220/1 T |
| 3,989,162 | 11/1976 | Hodge et al. . | |
| 4,014,457 | 3/1977 | Hodge . | |
| 4,098,429 | 7/1978 | Hodge . | |
| 4,182,530 | 1/1980 | Hodge . | |
| 4,488,624 | 12/1984 | Myers | 70/49 |
| 4,520,945 | 6/1985 | Hodge . | |

FOREIGN PATENT DOCUMENTS

| | | | |
|---|---|---|---|
| 9164 | of 1904 | United Kingdom | 217/68 |

*Primary Examiner*—Stephen Marcus

*Attorney, Agent, or Firm*—Poms, Smith, Lande & Rose

[57] ABSTRACT

A trash bin lid-locking device used to secure the lids of a trash bin against unauthorized use. The lid-locking device, which may be used for different types of trash bins, uses two flexible cables connected to two elongated locking members that slide on an elongated track support attached to the front of the trash bin. The locking members may be slid apart allowing the cables to be fit over the front corners and lids of the trash bin. The ends of the cables are then engaged to slotted brackets attached to the sides of the trash bin and the locking members are slid together and secured by a padlock. The cables may be removed from on top of the lids allowing authorized use of the trash bin by unlocking the padlock and sliding the locking members apart until sufficient slack is provided in the cables to allow the cables to be removed. Another embodiment of the lid-locking device uses a single cable that may be placed over the top of the lids. The cable passes through a loop of cable attached to the front wall of the trash bin and the ends of the cable are padlocked to brackets at the sides of the trash bin. Springs are provided at the ends of the cable for the purpose of holding the cable tight around the trash bin during dumping operations.

17 Claims, 3 Drawing Sheets

FIG. 1
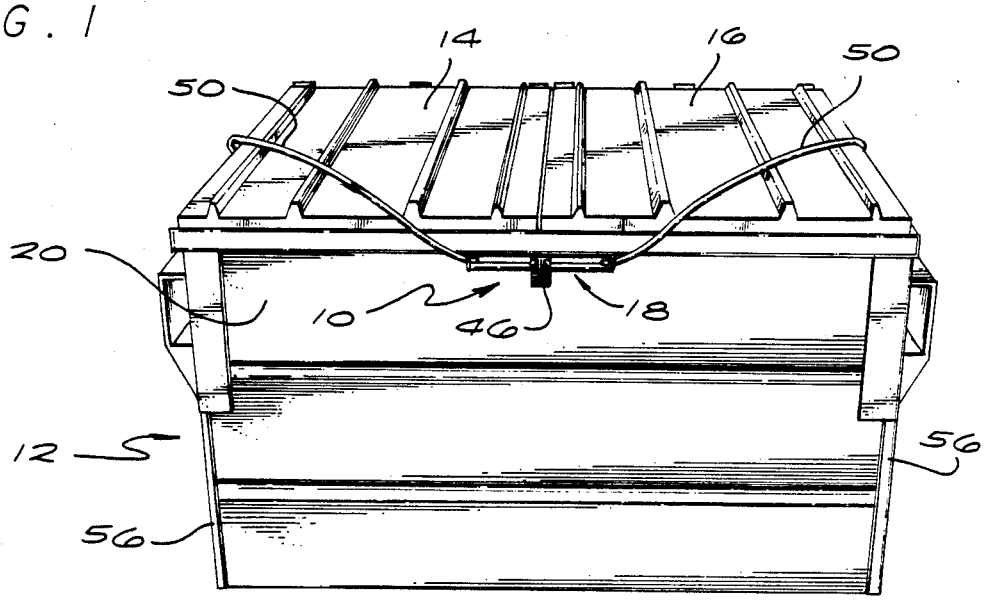
FIG. 2
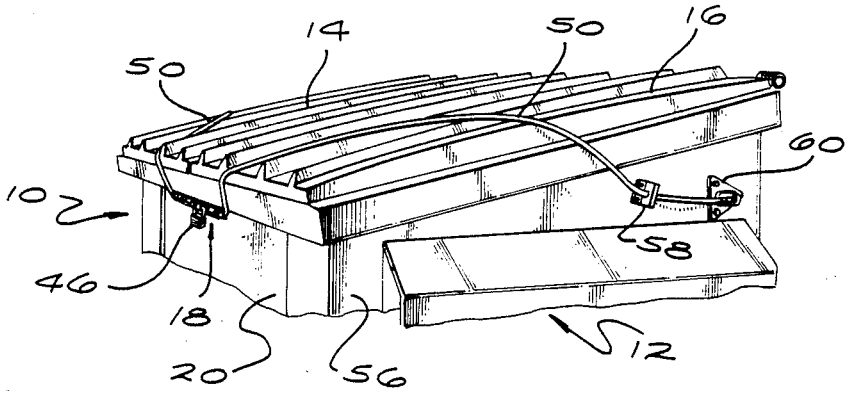
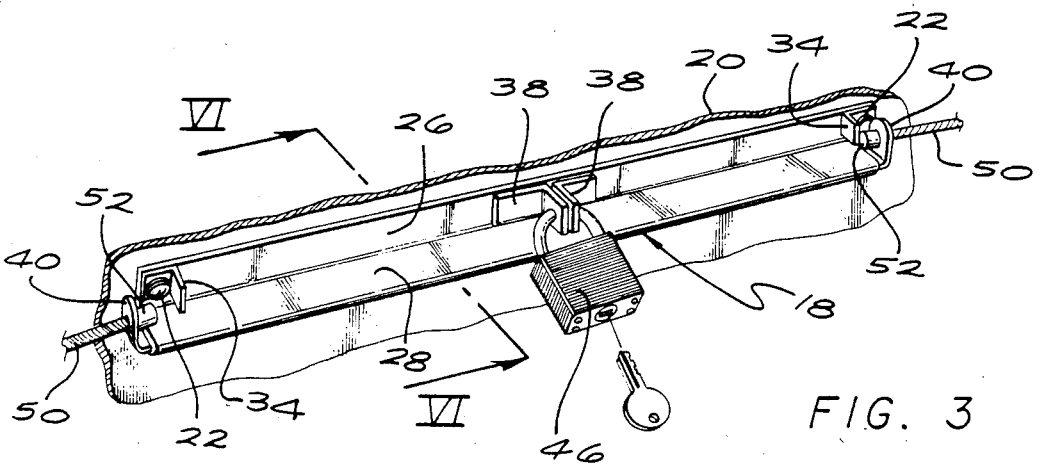
FIG. 3

FIG. 4
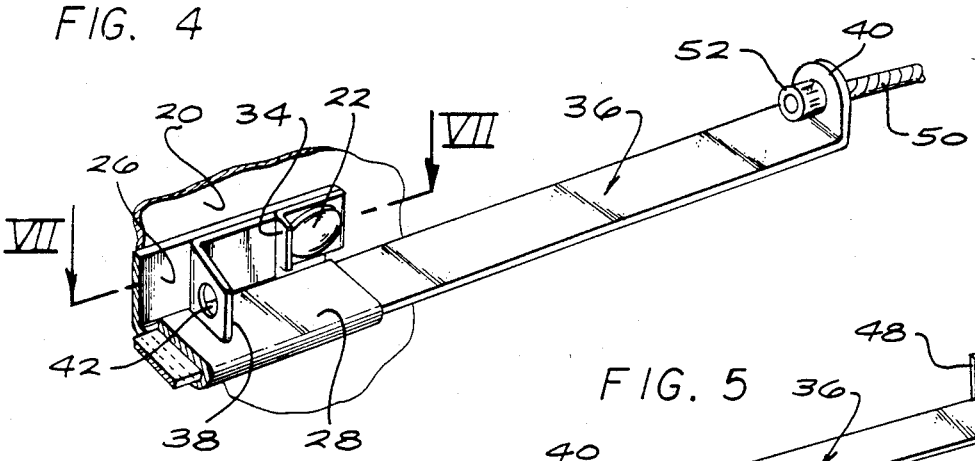
FIG. 5
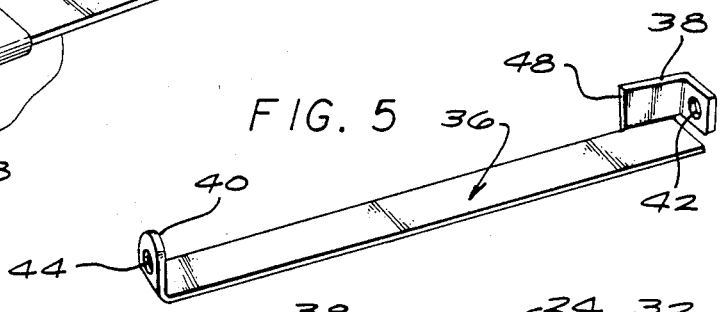
FIG. 6
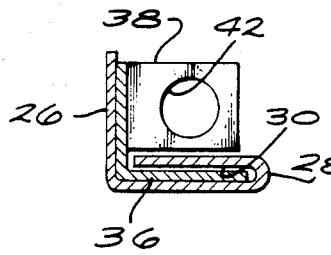
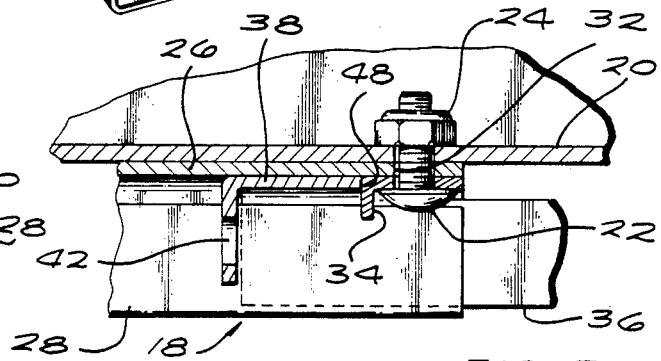
FIG. 7
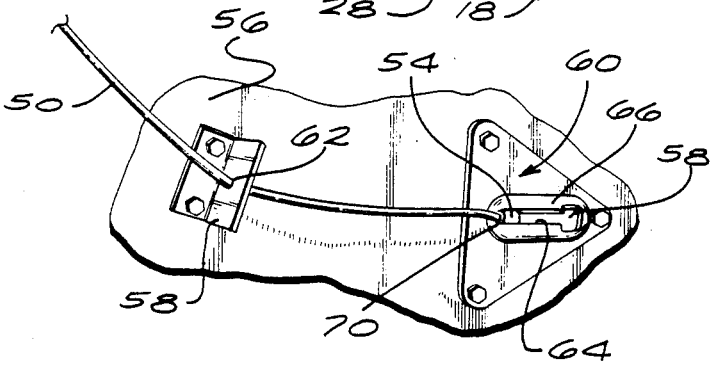
FIG. 8
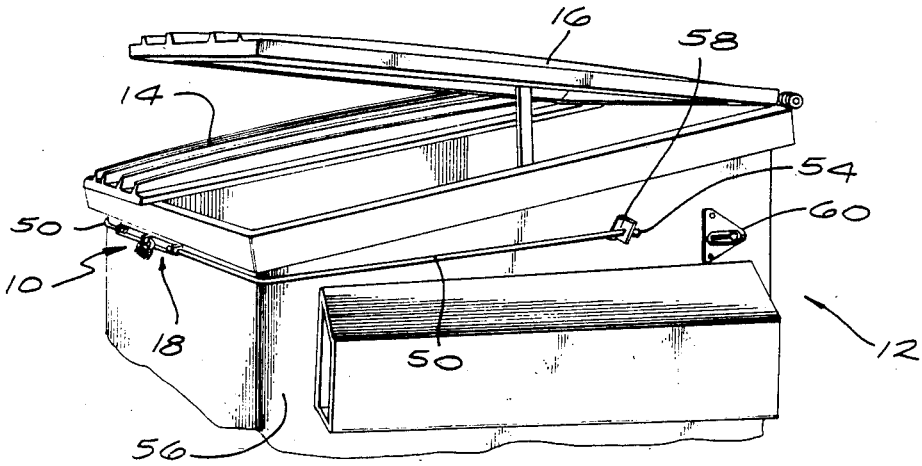
FIG. 9

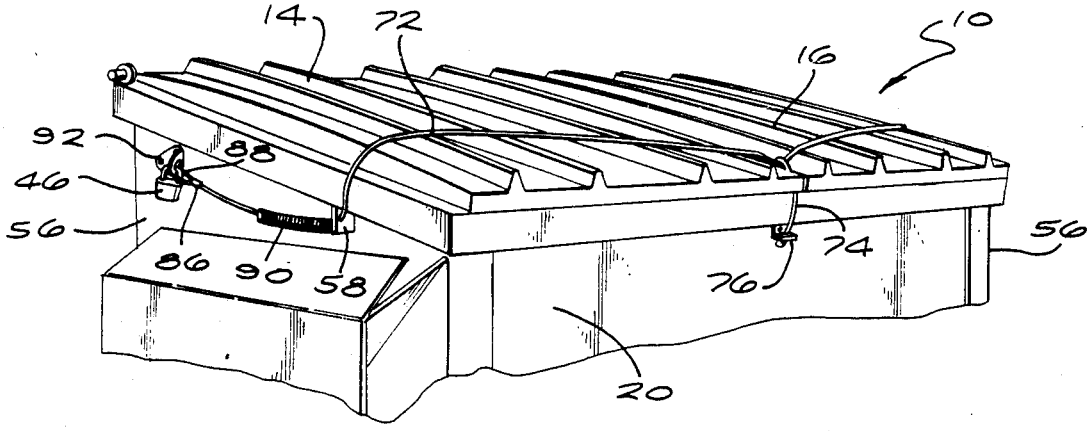
FIG. 10
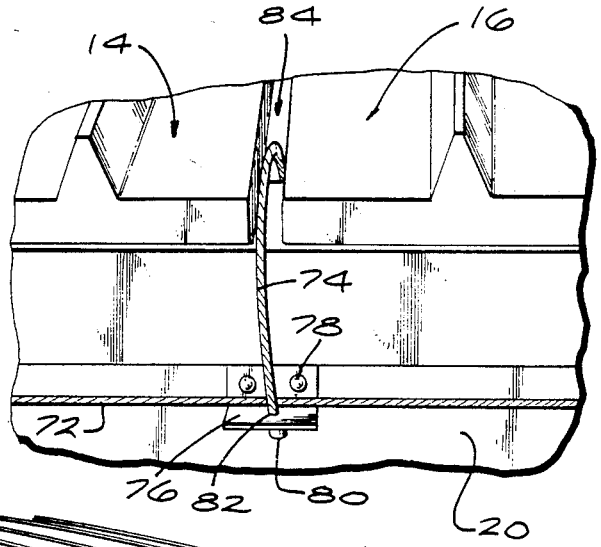
FIG. 11
FIG. 12
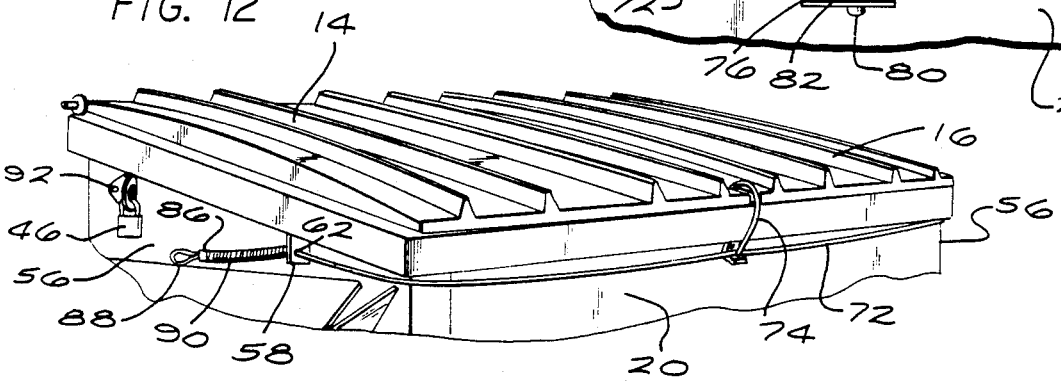
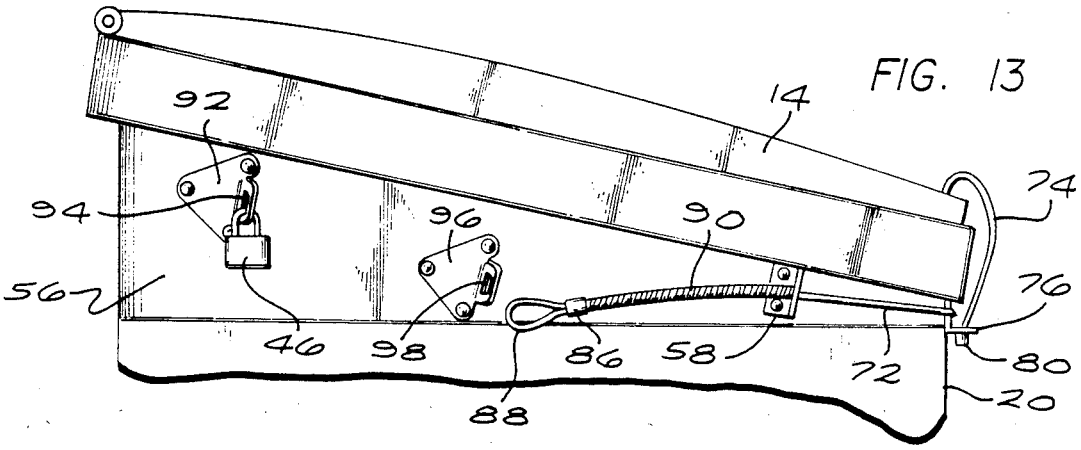
FIG. 13

TRASH BIN LID-LOCKING DEVICE

BACKGROUND OF THE INVENTION

The present invention relates generally to lid locks used for trash bins and, more particularly, to a trash bin lid-locking device using one or two flexible cables which fit over the front corners of or lids of a trash bin in order to lock or secure the trash bin's lids preventing unauthorized use of the bin.

In the past, users of trash bins and owners of commercial trash bins have experienced difficulty in preventing unauthorized use of the bins. As a result, various locking devices have been designed for trash bins in order to control access to the bins. For example, my prior U.S. Pat. No. 4,182,530, issued on January 8, 1980, discloses a commercial trash bin locking system used to prevent unauthorized use of a trash bin while still permitting the dumping of trash by lifting and inverting the trash bin without the need to manually open or unlock the trash bin prior to lifting the bin. Another such lid lock device which automatically opens the lids of a trash bin during dumping operations without the need for manual operation is disclosed in U.S. Pat. No. 3,687,317, issued to Gagel on August 29, 1972.

Another trash bin security system is described in my prior U.S. Pat. No. 4,520,945, issued on June 4, 1985, which keeps the lids on a trash bin closed by securing padlocks to cables connected to the lids. Other trash bin lid systems are disclosed in my prior U.S. Pat. Nos. Re. 30,890, reissued on March 30, 1982; 4,098,429, issued on July 4, 1978; 4,014,457, issued March 29, 1977; and 3,989,162, issued November 2, 1976.

U.S. Pat. No. 2,730,253, issued to Oswalt on January 10, 1956, describes a trip means used for opening ends of fruit boxes. A pail with a lid and latching mechanism is disclosed in U.S. Pat. No. 3,137,408, issued to Taylor on June 16, 1964.

However, such locking devices and systems are expensive to manufacture, some need more than one padlock, and often can only be used for a particular size or type of trash bin. In addition, some trash bins have plastic lids which prevent an owner from securely and permanently attaching some locking devices to the lids. Accordingly, there is a need for a simple trash bin lid-locking device, which may be installed on different types of trash bins, may be used with one padlock, is economical to manufacture, easy to ship or transport and simple to use, and does not require parts of the device to be attached to the lids of the trash bins.

SUMMARY OF THE INVENTION

It is an object of the invention to provide a trash bin lid-locking device which may be used to keep the lids of a trash bin closed, preventing unauthorized use of the bin, and allows a user to easily open the lids.

It is another object of this invention to provide a trash bin lid-locking device which may be easily installed on different types of trash bins of varying sizes and configurations.

It is still another object of this invention to provide a trash bin lid-locking device that is economical to manufacture and easy to transport or ship to customers or users.

It is still another object of this invention to provide a trash bin lid-locking device that securely keeps lids of different types of trash bins shut without requiring parts of the device to be attached to the lids of the bins.

These and other objects and advantages are attained by a trash bin lid-locking device used to secure the lids of a trash bin against unauthorized use. The lid-locking device, which may be used for different types of trash bins, uses two flexible cables connected to two elongated locking members that slide on an elongated track support attached to the front of the trash bin. Since the track support is not attached to the trash bin lids, the lid-locking device may be used for trash bins having plastic lids which might prevent an owner from securely attaching locking devices to the lids. The locking members may be slid apart allowing the cables to be fit over the front corners and lids of the trash bin. The ends of the cables are then engaged to slotted brackets attached to the sides of the trash bin and the locking members are slid together and secured by a padlock. In this locked position, the cables fit tightly over the lids preventing unauthorized use of the trash bin.

The cables may be removed from on top of the lids allowing authorized use of the trash bin by unlocking the padlock and sliding the locking members apart until sufficient slack is provided in the cables to allow the ends of the cables to be disengaged from the slotted brackets and the cables to be slid from on top of the trash bin lids. The cables may be secured around the bottom of the trash bin by unlocking the padlock, removing the cables from the corners of the bin and then securing the locking members together again by the padlock.

It is also noted that a single cable could be employed extending across the trash bin lid or lids and secured to the sides of the trash bin by brackets similar to those employed with the dual cable system.

Another embodiment of the trash bin lid-locking device is provided which uses a single cable that may be placed over the top of the trash bin lids in order to keep the lids closed. The cable passes through a loop of cable attached to the front wall of the trash bin and through retaining brackets attached to both sides of the bin. At least one end of the cable has a loop attached to it which may be secured by a padlock to a locking bracket attached to the side of the trash bin. The other end of the cable at the opposite side of the trash bin may also be secured by a padlock to another locking bracket attached to the opposite side, if desired, or may be simply engaged to the retaining bracket at the opposite side. A spring may be provided between the loop at the end of the cable and the retaining bracket (springs may be provided at both ends of the cable if desired). After the padlocks are unlocked, the cable may be slid off the lids for the purpose of providing access to the trash bin and secured around the trash bin. When secured in this position, the springs keep the cable tight around the trash bin so that the cable is not hanging loose in the way of an operator during dumping operations.

The various features of the present invention will be best understood together with further objects and advantages by reference to the following description of the preferred embodiment taken in conjunction with the accompanying drawings.

BRIEF DESCRIPTION OF THE DRAWINGS

FIG. 1 is front perspective view of a trash bin with a lid-locking device illustrating the principles of the present invention showing how two flexible cables may be fit or placed over the front corners and lids of the trash bin in order to keep the lids of the bin closed;

FIG. 2 is a side perspective view of the trash bin of FIG. 1 showing how one of the cables fits over a corner and lid of the trash bin with one end of the cable engaging a slotted bracket attached to the side of the trash bin;

FIG. 3 is an enlarged perspective view showing how two elongated locking members of the lid-locking device of FIG. 1 may be secured together by a padlock;

FIG. 4 is an enlarged perspective view showing how a locking portion of one of the elongated locking members contacts a stop member of an elongated track support restricting further movement of the locking member;

FIG. 5 is an enlarged perspective view of one of the elongated locking members;

FIG. 6 is a cross-sectional view taken in the direction of arrows VI—VI shown in FIG. 3;

FIG. 7 is a cross-sectional view taken in the direction of arrows VII—VII shown in FIG. 4;

FIG. 8 is an enlarged detailed view showing how one of the cables slidably engages a retaining bracket attached to the trash bin and removably engages a slotted bracket attached to the bin;

FIG. 9 is a side perspective view of the trash bin of FIG. 1 showing one of the trash bin lids opened after the flexible cables have been slid off the corners and lids of the trash bin and secured around the bin by sliding the two locking portions together and securing the portions by a padlock so that slack is taken out of the cables and movement of the ends of the cables is restricted by retaining brackets attached to the sides of the trash bin;

FIG. 10 is a side perspective view of a trash bin with another embodiment of the present invention showing how a single cable may be fit or placed on top of the lids of the trash bin in order to keep the lids closed;

FIG. 11 is an enlarged detailed view of a loop of cable attached to the front wall of the trash bin which the single cable passes through;

FIG. 12 is a side perspective view of the trash bin showing the single cable after it has been slid off the trash bin lids and secured around the bin with a spring at one end of the cable holding the cable tight around the bin; and FIG. 13 is a side elevational view of the trash bin showing the single cable held tight around the trash bin by the spring, a locking bracket with a padlock attached which may be used to secure one end of the cable to the side of the bin when the cable is used to keep the lids shut as shown in FIG. 10 and an auxiliary bracket which may be used instead of the spring for the purpose of keeping the cable tight around the trash bin by attaching the end of the cable to the auxiliary bracket.

DESCRIPTION OF THE PREFERRED EMBODIMENTS

The following specification taken in conjuction with the drawings sets forth the preferred embodiments of the present invention in such a manner that any person skilled in the art can make and use the invention. The embodiments of the invention disclosed herein are the best modes contemplated by the inventor for carrying out his invention in a commercial environment although it should be understood that various modifications can be accomplished within the parameters of the present invention.

FIGS. 1 and 2 show a preferred embodiment of the trash bin lid-locking device 10 of the present invention. The device 10 may be installed on different types of trash bins such as the trash bin 12 shown having lids 14 and 16. However, it is important to note that the lid-locking device 10 may be installed on any type of trash bin having lids at the top of the bin that open in an upward direction (see FIG. 9). In addition, the device 10 may be used for a trash bin 12 having only one lid (not shown).

Referring now to FIGS. 3 through 8, the lid-locking device 10 has an elongated track support 18 which is mounted on front wall 20 of the trash bin 12 by bolts 22 and nuts 24 (see FIG. 7). Any type of fastening devices may be used instead of the bolts 22 and nuts 24 such as rivets, pins, screws, clamps, or the like, and support 18 may be welded or otherwise attached to wall 20 if desired. Note that the elongated track support 18 is not attached to the lids 14 and 16. As a result, the device 10 may be used with trash bins that have plastic or rubber lids. Other locking devices that are attached to the lids of a trash bin may cause damage if the lids are made out of plastic or a material that is susceptible to cracking, bending, etc. Thus, the trash bin lid-locking device 10 of this invention may be used for trash bins using lids made out of any type of material.

The elongated track support 18 has a vertical sheet portion 26 formed integrally with a U-shaped horizontal sheet portion 28 as best shown in FIG. 6. Portion 28 forms an elongated groove or channel 30. Portions 26 and 28 are preferably formed or shaped out of a single piece of sheet metal. However, any type of rigid material may be used for portions 26 and 28 such as aluminum, stainless steel, plastic, or the like, and the portions may be formed separately and welded or otherwise attached together if desired. Portion 26 has apertures 32 (see FIG. 7) for bolts 22. Two stop members 34 are attached to the vertical sheet portion 26 by bolts 22 (see FIG. 7). Alternatively, stop members 34 may be welded to portion 26 or otherwise attached and may be formed as an integral part of portion 26.

Two elongated locking members 36 slidably engage channel 30 of the elongated track support 18 as shown in FIGS. 3, 4, 6 and 7. Each elongated locking member 36 has a locking portion 38 at one end thereof and a lug 40 at the other end thereof. Portions 38 are preferably L-shaped. Locking portions 38 and lugs 40 have apertures 42 and 44, respectively, therein. Portions 38 and lugs 40 may be formed integrally as parts of locking members 36, or may be welded or otherwise attached to the members.

The elongated locking members 36 are capable of sliding longitudinally along the elongated track support 18 until the locking portions 38 come together as shown in FIG. 3. When in this position, the locking members 36 may be locked together and prevented from sliding by securing a padlock 46 to the locking portions 38 using apertures 42 as shown in FIG. 3. When unlocked and free to slide, the locking members 36 are prevented from sliding off the track support 18 by ends 48 of the locking portions 38 which contact the stop members 34 as illustrated in FIG. 7.

Two flexible cables 50 are connected to the lugs 40 at the ends of the locking members 36. The cables 50 are preferably steel cables but may be made out of any durable material such as other metals, nylon cord, rope, or the like. However, steel cables are preferred to prevent someone from cutting through the cables 50 (3/16-inch steel galvanized cable is preferred). The cables 50 slidably engage apertures 44 of the lugs 40 and are kept from sliding free of the lugs 40 by end members 52 attached to the ends of the cables. Attached to the opposite ends of the cables 50 are end members 54 (see FIG. 8).

Referring now to FIGS. 2 and 8, each side 56 of the trash bin 12 has a retaining bracket 58 and a slotted bracket 60 attached to it. Each retaining bracket 58 has an aperture 62 therein and each slotted bracket 60 has an elongated slot 64 in a raised portion 66 thereof with an enlarged opening 68 at the end of the slot 64. As shown, slot 64 and opening 68 preferably form a generally keyhole-shaped configuration. However, any shape configuration may be used that allows the ends of the cables 50 or end members 54 to releasably engage the slotted brackets 60. As best shown in FIG. 8, cables 50 slidably engage apertures 62 in retaining brackets 58 so that end members 54 may be inserted into openings 68 and slid to ends 70 of the slots 64 opposite openings 68 in such a way that the ends of the cables are releasably engaged or anchored to the slotted brackets 60. The ends of the cables 50 may be disengaged from the slotted brackets 60 by sliding end members 54 away from ends 70 until the members 54 may be removed from the brackets 60 through openings 68. After the cables 50 are disengaged from the slotted brackets 60, movement of the ends of the cables 50 is restricted by the retaining brackets 58 when end members 54 come into contact with the brackets 58 (the size of end members 54 is greater than the diameter of apertures 62).

The trash bin lid-locking device 10 is used as follows. In order to secure the lids 14 and 16 of the trash bin 12 shut, the ends of cables 50 are engaged to the slotted brackets 60 by inserting end members 54 into openings 68 of the brackets. The two elongated locking members 36 are then slid apart on the elongated track support 18 until enough slack exists in the cables 50 to allow the cables to be fit or placed over the front corners and lids of the trash bin 12. The locking members 36 are then slid together so that the cables 50 fit tightly over the corners and lids of the trash bin 12 after the locking portions 38 are secured together by the padlock 46. When the lid-locking device 10 is padlocked in this manner, the lids 14 and 16 of the trash bin 12 cannot be opened, preventing unauthorized use of the bin. The trash bin lids 14 and 16 may be easily opened by an authorized user by unlocking the padlock 46 and sliding the elongated locking members 36 apart until enough slack exists in the cables 50 to allow the ends of the cables to be disengaged from the slotted brackets 60 by removing end members 54 from the brackets through openings 68. The cables 50 may then be slid off the corners and lids of the trash bin 12 allowing an authorized user to open lids 14 and 16.

After the cables 50 are removed from the corners of the trash bin 12, they may be secured around the bottom of the trash bin leaving the lids 14 and 16 unlocked for garbage collection purposes by sliding the locking portions 38 together and locking the portions with the padlock 46 so that slack is taken out of the cables and the cables are held tightly around the bin. When locked in this manner, movement of the ends of the cables 50 is restricted by the retaining brackets 58 and the cables are held taut as shown in FIG. 9. As such, the cables 50 when secured around the bin 12 are not hanging loose in the way of an operator during dumping operations.

FIGS. 10 through 13 show another preferred embodiment of the trash bin lid-locking device 10 of the present invention that uses a single cable 72 which fits over and across lids 14 and 16 of trash bin 12 for the purpose of securing the lids shut. The cable 72 fits through a loop of cable 74 attached to the front wall 20 of the trash bin 12. Any desirable means may be used to attach the loop of cable 74 to wall 20 such as a bracket 76 secured to the wall 20 by nuts and bolts, screws, rivets 78, or the like, as shown in FIG. 11. The bracket 76 may also be welded to the front wall 20 if desired. Note that end member 80 prevents one end of the loop of cable 74 from sliding free of aperture 82 in the bracket 76. The other end of loop 74 would be attached in a similar way to wall 20 inside the trash bin 12 using another bracket 76 or some other means of attachment. It is intended that this invention not be limited by the means used to attach the loop of cable 74 to the front wall 20. For example, end members 80 may be welded to wall 20 or the loop of cable 74 may be fit through an aperture in wall 20 and the ends of the loop secured together. Also, note that the loop of cable 74 fits in area 84 between lids 14 and 16.

Retaining brackets 58 are attached to both sides 56 of the trash bin 12. The brackets 58 are preferably like the bracket 58 shown in FIG. 8 and cable 72 passes through apertures 62 in the brackets 58. An end member 86 and a loop 88 are attached to at least one end of cable 72. A spring 90 fits around the cable 72 and is trapped between bracket 58 and end member 86. The spring 90 is preferably free to slide on cable 72, but may be attached to the cable 72 or member 86 if desired. Also attached to at least one side 56 of the trash bin 12 is a locking bracket 92 having an aperture 94 therein.

The cable 72 may be used to secure the lids 14 and 16 shut by fitting, placing or pulling the cable 72 over or on top of the lids as shown in FIG. 10 so that the cable 72 moves up the loop of cable 74 until it is held back by the loop. Preferably, one end of the cable 72 engages an aperture 62 in one of the brackets 58 at one side 56 of the trash bin 12 and has an end member 54 attached thereto which prevents the end of the cable 72 from pulling free of bracket 58 similar to how the end of cable 50 is held in place by bracket 58 as shown in FIG. 9. The opposite end of cable 72 at the opposite side 56 of the trash bin 12 has loop 88 and end member 86 attached to it and spring 90 fitting around the cable as discussed above. After the cable 72 has been placed on top of the lids 14 and 16, loop 88 is then secured to locking bracket 92 by padlock 46 using aperture 94 as shown in FIG. 10, causing the cable 72 to be pulled tight or taut over the lids thereby holding or securing the lids shut. A customer or user of the trash bin 12 would have a key to the padlock 46 for the purpose of opening the lids 14 and 16 as well as an operator or hauler who picks up garbage or trash from the bin 12.

The trash bin lid-locking device 10 may have loop 88, end member 86 and spring 90 at each end of the cable 72 with locking brackets 92 at both sides 56 of the trash bin 12 if desired. In such a case, different padlocks 46 may be used for the opposite sides 56 of the trash bin 12, allowing a user of the trash bin to have a key to one of the padlocks 46 and a hauler to have a key to the other padlock 46, providing access to both parties.

After the padlock 46 has been unlocked, the cable 72 may be slid off the lids 14 and 16 and secured around the trash bin 12 as shown in FIG. 12, causing end member 86 to compress spring 90 and the spring 90 to push against member 86 and bracket 58, which provides sufficient biasing forces to hold the cable 72 tight around the bin 12. If spring 90 is used at each end of the cable 72, then the springs 90 at both ends would work together to keep the cable 72 tight around the trash bin 12. Thus, the cable 72, when secured around the trash bin 12 as shown in FIG. 12, is not hanging loose in the way of an operator during dumping operations.

FIG. 13 shows an auxiliary bracket 96 with aperture 98 therein which may be attached to one or both sides 56 of the trash bin 12. Bracket 96 may be used instead of spring 90 for the purpose of holding cable 72 tight around the trash bin 12 by simply using padlock 46 and aperture 98 to secure loop 88 to the bracket 96. Thus, the lid-locking device 10 may be used without springs 90 if desired.

The lid-locking device 10 may also be used without loop of cable 74 if desired. In such a case, cable 72 is pulled tight over lids 14 and 16 parallel to the front edges of the lids. However, the use of loop 74 is preferred because lids 14 and 16 are more securely held in place by cable 72 when loop of cable 74 is used due to the midpoint of the cable 72 providing more downward forces near the front of the lids adjacent loop 74.

The trash bin lid-locking device 10 may be conveniently shipped to customers because it is relatively lightweight and the cable may be coiled up and placed in a box for transport. In addition, the lid-locking device 10 is easily installed on any size or configuration trash bin 12 because brackets 58, 76 and 92 may be attached to the bin using a minimum of tools and cable 72 may be provided in desired lengths to fit the different sizes of bins. For example, a trash bin 12 that is 72 inches across requires a cable 72 approximately 108 inches long. Approximately 15 inches of cable is needed for the loop of cable 74. However, the lengths of the cable 72 and loop of cable 74 may be varied as needed to fit the different trash bin 12 sizes.

The above description discloses the preferred embodiments of the present invention. However, persons of ordinary skill in the art are capable of numerous modifications once taught these principles such as, by way of example and not limitation, different types of track supports and locking members which slidably engage each other, different devices for releasably engaging the ends of the cables, or other types of retaining brackets used to guide the cables or restrict movement of the ends thereof. Further, instead of using two cables, a single cable could be secured over the lids, parallel to the front edges of the lids with one end of the cable secured on one side of the trash bin by an assembly including brackets such as brackets 58 and 60, and the other end of the cable secured to and selectively locked to an assembly mounted on the opposite side of the trash bin having two parts slidably engaging each other such as member 36 and support 18. Accordingly, it will be understood by those skilled in the art that changes in form and details may be made to the above-described embodiments without departing from the spirit and scope of the invention.

I claim:

1. A trash bin lid-locking device used to secure the lids of a trash bin, each of said lids having front corners, said device comprising:

two flexible cables, each of said cables having first and second ends;

means mounted on front of said trash bin and engaged to said first ends of said cables for selectively securing said lids shut and for selectively allowing said lids to be opened by providing slack in said cables allowing said cables to be (1) removably placed over said front corners of said lids preventing opening of said lids, and (2) subsequently removed from on top of said front corners allowing said lids to be opened; and first bracket means attached to sides of said trash bin for selectively engaging said second ends of said cables.

2. The lid-locking device of claim 1 further comprising second bracket means attached to said sides of said trash bin for restricting movement of said second ends of said cables after said second ends are disengaged from said first bracket means.

3. A trash bin lid-locking device used to secure the lids of a trash bin comprising:

two flexible cables;

means mounted on front of said trash bin and coupled to said cables for selectively preventing the opening of said lids by allowing said cables to be removably placed over front corners of said lids, said means for selectively preventing the opening of said lids including:

(a) an elongated track support attached to said front of said trash bin, and (b) two elongated locking members slidably engaging said track support, said locking members having locking portions capable of being secured together by a padlock, said cables having second ends coupled to said locking members; and first bracket means attached to sides of said trash bin for selectively engaging first ends of said cables.

4. The lid-locking device of claim 3 wherein each of said first bracket means has an elongated slot and an enlarged opening therein, each of said cables having a first end member attached to said first end capable of releasably engaging said slot and said opening of one of said first bracket means.

5. The lid-locking device of claim 4 further comprising retaining brackets attached to sides of said trash bin, said cables slidably engaging apertures in said brackets so that movement of said first ends of said cables is restricted by said retaining brackets when said first ends are disengaged from said first bracket means and said first end members come into contact with said retaining brackets.

6. The lid-locking device of claim 5 wherein said two elongated locking members have lugs with apertures therein, said cables slidably engaging said apertures of said lugs and having second end members attached to said second ends thereof, said second end members attached to said second ends thereof, said second end members preventing said cables from sliding free of said lugs.

7. A trash bin lid-locking device used to secure the lids of a trash bin comprising:

two flexible cables;

an elongated track support mounted on front of said trash bin;

two elongated locking members slidably engaging said track support, said locking members capable of being slid together so that locking portions thereof may be releasably secured together by a padlock, said cables having first ends coupled to said locking members; and slotted brackets attached to sides of said trash bin, said cables having second ends capable of releasably engaging said slotted brackets so that said lids of said trash bin are kept shut when said second ends are engaged to said slotted brackets.

8. The lid-locking device of claim 7 further comprising retaining brackets attached to said sides of said trash bin, said cables slidably engaging apertures in said retaining brackets so that movement of said second ends of said cables is restricted by said retaining brackets when said second ends are disengaged from said slotted brackets and first end members attached to said cables at said second ends come into contact with said retaining brackets.

9. The lid-locking device of claim 8 wherein said two elongated locking members have lugs attached thereto, said cables having second end members attached thereto at said first ends, said cables slidably engaging apertures in said lugs so that said second end members keep said cables from sliding free of said lugs.

10. A trash bin lid-locking device used to keep the lids of a trash bin closed comprising:

a flexible cable;

first bracket means attached to one side of said trash bin for selectively securing a first end of said flexible cable;

second bracket means attached to the opposite side of said trash bin for selectively securing a second end of said flexible cable, said flexible cable being of such a length that it is capable of being (1) selectively placed on top of said lids and then pulled taut over said lids when said ends are engaged to said first and second bracket means in order to prevent opening of said, lids and (2) subsequently removed from on top of said lids allowing said lids to be opened after at least one of said ends is disengaged from its corresponding one of said first and second bracket means; and means for engaging at least one of said ends and for holding said flexible cable tight around said trash bin after said flexible cable has been removed from on top of said lids.

11. A trash bin lid-locking device used to keep the lids of a trash bin closed comprising:

a flexible cable;

first bracket means attached to one side of said trash bin for selectively securing a first end of said flexible cable;

second bracket means attached to the opposite side of said trash bin for selectively securing a second end of said flexible cable, said flexible cable being of such a length that it is capable of being (1) selectively placed on top of said lids and then pulled taut over said lids when said ends are engaged to said first and second racket means in order to prevent opening of said lids, and (2) subsequently removed from on top of said lids allowing said lids to be opened after at least one of said ends is disengaged from its corresponding one of said first and second bracket means;

means for engaging at least one of said ends and for holding said flexible cable tight around said trash bin after said flexible cable has been removed from on top of said lids; and a loop of cable attached to the front of said trash bin, said flexible cable passing through said loop of cable.

12. A trash bin lid-locking device used to keep the lids of a trash bin closed comprising:

a flexible cable;

first bracket means attached to one side of said trash bin for selectively securing a first end of said flexible cable;

second bracket means attached to the opposite side of said trash bin for selectively securing a second end of said flexible cable, said flexible cable being of such a length that it is capable of being (1) selectively placed on top of said lids and then pulled taut over said lids when said ends are engaged to said first and second bracket means in order to prevent opening of said lids, and (2) subsequently removed from on top of said lids allowing said lids to be opened after at least one of said ends is disengaged from its corresponding one of said first and second bracket means; and means for engaging at least one of said ends and for holding said flexible cable tight around said trash bin after said flexible cable has been removed from on top of said lids, said engaging and holding means including a spring engaged to said one of said ends.

13. A trash bin lid-locking device used to keep the lids of a trash bin closed comprising:

a flexible cable;

first bracket means attached to one side of said trash bin for selectively securing a first end of said flexible cable;

second bracket means attached to the opposite side of said trash bin for selectively securing a second end of said flexible cable, said flexible cable being of such a length that it is capable of being (1) selectively placed on top of said lids and then pulled taut over said lids when said ends are engaged to said first and second bracket means in order to prevent opening of said lids, and (2) subsequently removed from on top of said lids allowing said lids to be opened after at least one of said ends is disengaged from its corresponding one of said first and second bracket means; and means for engaging at least one of said ends and for holding said flexible cable tight around said trash bin after said flexible cable has been removed from on top of said lids, said engaging and holding means including an auxiliary bracket with an aperture therein attached to said one side, said first end of said flexible cable having a loop attached thereto, said first end capable of being secured to said auxiliary bracket by a padlock engaging said loop and said aperture of said auxiliary bracket.

14. A trash bin lid-locking device used to keep the lids of a trash bin closed comprising:

a flexible cable;

first bracket means attached to one side of said trash bin for selectively securing a first end of said flexible cable;

second bracket means attached to the opposite side of said trash bin for selectively securing a second end of said flexible cable, said flexible cable being of such a length that it is capable of being (1) selectively placed on top of said lids and then pulled taut over said lids when said ends are engaged to said first and second bracket means in order to prevent opening of said lids, and (2) subsequently removed from on top of said lids allowing said lids to be opened after at least one of said ends is disengaged from its corresponding one of said first and second bracket means;

means for engaging at least one of said ends and for holding said flexible cable tight around said trash bin after said flexible cable has been removed from on top of said lids; and a first retaining bracket with an aperture therein attached to said one side of said trash bin, said flexible cable passing through said aperture of said first retaining bracket near said first end of said flexible cable, said first end having a loop and an end member attached thereto, said flexible cable having a first of said engaging and holding means engaged to said first end between said end member and said first retaining bracket.

15. The lid-locking device of claim 14 wherein said second bracket means comprises a second retaining bracket with an aperture therein attached to said opposite side of said trash bin, said flexible cable passing through said aperture of said second retaining bracket near said second end of said flexible cable, said second end having an end member attached thereto preventing said second end from disengaging from said second retaining bracket.

16. The lid-locking device of claim 14 further comprising a second retaining bracket with an aperture therein attached to said opposite side of said trash bin, said flexible cable passing through said aperture of said second retaining bracket near said second end, said second end having a loop and an end member attached thereto, said flexible cable having a second of said engaging and holding means engaged to said second end between said end member at said second end and said second retaining bracket.

17. A trash bin-locking device used to keep the lids of a trash bin closed comprising:

a flexible cable;

first bracket means attached to one side of said trash bin for selectively securing a first end of said flexible cable;

second bracket means attached to the opposite side of said trash bin for selectively securing a second end of said flexible cable, said flexible cable being of such a length that it is capable of being (1) selectively placed on top of said lids and then pulled taut over said lids when said ends are engaged to said first and second bracket means in order to prevent opening of said, lids and (2) subsequently removed from on top of said lids allowing said lids to be opened after at least one of said ends is disengaged from its corresponding one of said first and second bracket means; and third bracket means attached to said one side of said trash bin for selectively securing said first end of said flexible cable in order to hold said flexible cable tight around said trash bin after said flexible cable has been removed from on top of said lids.

* * * * *